United States Patent [19]

Brint et al.

[11] Patent Number: 4,471,549

[45] Date of Patent: Sep. 18, 1984

[54] ACTUATING MECHANISMS FOR SMALL ARMS

[75] Inventors: Norman T. Brint, Waltham Abbey; Jack W. Comley, Cheshunt, both of England

[73] Assignee: The Secretary of State for Defence in Her Britannic Majesty's Government of the United Kingdom of Great Britain and Northern Ireland, England

[21] Appl. No.: 361,923

[22] PCT Filed: Jul. 1, 1981

[86] PCT No.: PCT/GB81/00122

§ 371 Date: Mar. 15, 1982

§ 102(e) Date: Mar. 15, 1982

[87] PCT Pub. No.: WO82/00345

PCT Pub. Date: Feb. 4, 1982

[30] Foreign Application Priority Data

Jul. 14, 1980 [GB] United Kingdom ..... 8022929

[51] Int. Cl.[3] ..... F41C 11/06

[52] U.S. Cl. ..... 42/15; 42/18; 42/19; 42/69 A

[58] Field of Search ..... 42/15, 39.5, 59; 89/1.704, 1.705, 1.706, 1.803, 1.804, 189

[56] References Cited

U.S. PATENT DOCUMENTS

| | | | |
|---|---|---|---|
| 2,987,965 | 6/1961 | Musser | 89/1.706 |
| 3,745,687 | 7/1973 | Koon | 42/19 |
| 3,783,739 | 1/1974 | Perrine | 89/189 |

FOREIGN PATENT DOCUMENTS

| | | |
|---|---|---|
| 94726 | 5/1896 | Fed. Rep. of Germany . |
| 319361 | 3/1920 | Fed. Rep. of Germany . |
| 363122 | 7/1906 | France . |
| 2070547 | 9/1971 | France . |
| 105270 | 4/1924 | Switzerland . |
| 805533 | 12/1958 | United Kingdom . |

*Primary Examiner*—Stephen C. Bentley

*Attorney, Agent, or Firm*—Cushman, Darby & Cushman

[57] ABSTRACT

A self-loading firearm for firing rubber bullets and the like has an actuating mechanism comprising a toggle linkage which is straightened on operation of the trigger against its spring bias. Initial straightening of the toggle linkage moves the breech block forward to locate a round of ammunition in a short socket at the chamber end of the barrel. As the toggle linkage moves over center it locks the breech block forward and displaces a sear to release the firing pin. The round is fired with its case virtually unsupported. On release of the trigger the toggle mechanism is bent so withdrawing the breech block and the spent round which is automatically ejected. The firing pin is simultaneously re-cocked. Rotary and vertical stacking rechargeable magazines are described, from which a fresh round is automatically fed to the breech on ejection of a spent round.

5 Claims, 14 Drawing Figures

ACTUATING MECHANISMS FOR SMALL ARMS

Figure 1:
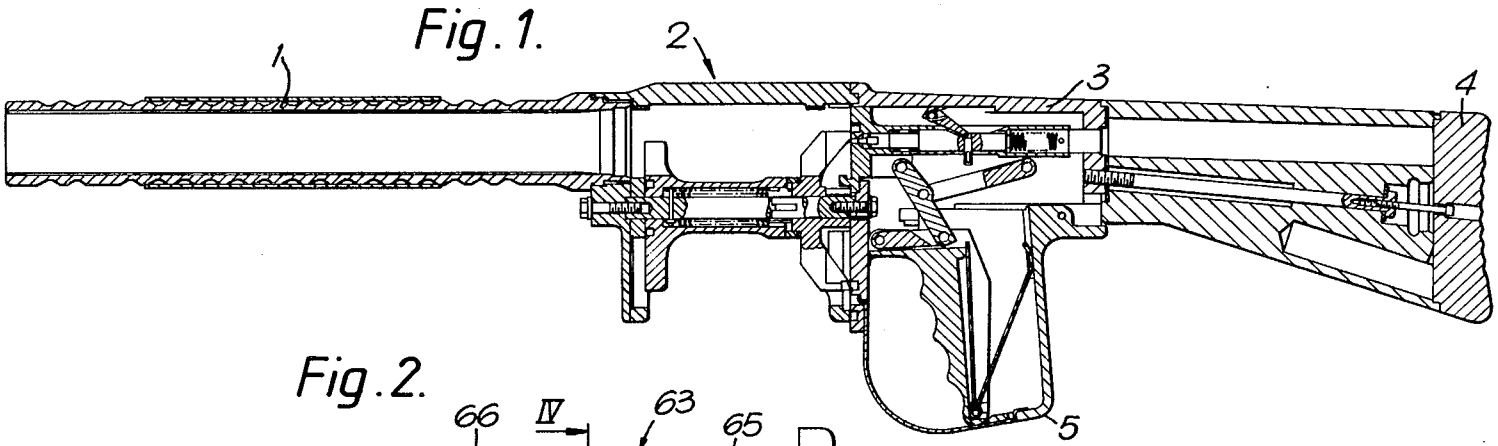

This invention relates to firearms, and in particular to an actuating mechanism for a firearm. The invention is especially but not exclusively concerned with self-loading firearms capable of firing a number of rounds in rapid succession, and these rounds may comprise projectiles in the form of, for example, so called "rubber bullets", grenades, or other fragmentation devices, or gas canisters.

In conventional practice the round to be fired comprises a projectile and a cartridge case containing a quantity of explosive which can be initiated by operation of the firearm to provide the energy necessary to eject the projectile from the barrel of the firearm with considerable velocity. The cartridge case is conventionally rather weak mechanically, and at the time of firing it must therefore be supported by being fully inserted into a chamber in which it fits closely to receive mechanical support from the chamber wall. From this necessity it has followed that any self-loading mechanism must be capable of first moving each round in turn laterally into alignment with the chamber, and then longitudinally through a relatively long stroke sufficient to achieve full insertion of the cartridge case into the chamber. This requirement has caused a number of constraints on the freedom of the designer.

The present applicant has appreciated the possibility that in some instances a round might be fired in a partially supported or a substantially unsupported state, ie without the necessity for the cartridge case to be fully inserted into a supporting chamber. A relatively small forward motion of the round after alignment with the barrel may still be necessary, in order to ensure positive location of the round prior to firing, but the stroke can be very considerably shorter, and this opens the possibility of a novel and considerably simplified actuating mechanism, which is also capable of ensuring the small forward movement of the round which may be necessary before firing takes place.

Conventional practice has also been that, following the initial cocking of the weapon, the energy necessary to operate a self-loading mechanism for chambering successive rounds has been derived in each firing cycle from the energy release by firing the previous round. Thus, for example either the re-coil energy has been harnessed for this purpose, or some of the energy present in the gases generated on firing has been used. It has been necessary to provide relatively complex devices for energising the self-loading mechanism in these ways. It is a feature of the actuating mechanism of the present invention that the cocking of the firing pin and any longitudinal movement required of each fresh round fed into place is energised by manual operation of the trigger mechanism itself, thus providing the possibility for considerable simplification of design.

According to the present invention, an actuating mechanism for a firearm having a body and a breech comprises a breech block slideable longitudinally relative to the body of the firearm and having a forward breech end for engaging and pushing forward a round of ammunition in the breech;

a firing pin slideable longitudinally relative to the body and to the breech block;

resilient means which can be stressed by forward movement of the breech block relative to the firing pin;

detent means engageable with the firing pin to prevent longitudinal movement of the firing pin relative to the body of the firearm;

and a toggle mechanism comprising first and second toggle bars and forming at least a part of an operative linkage between a trigger and the breech block;

the first toggle bar being pivotally connected at a first pivot point to the breech block, the second toggle bar being pivotally connected at a second pivot point to the body of the firearm said first pivot point being forward of said second pivot point, and the first and second toggle bars being pivotally connected together at a third pivot point, the trigger being operatively linked with the toggle mechanism whereby initial operation of the trigger moves the third pivot point towards alignment with the first and second pivot points so that the breech block is moved forwards and the resilient means is stressed, and whereby further operation of the trigger moves the toggle mechanism over centre to lock the breech block forward and releases the detent means.

Advantageously the detent means comprises a sear engageable in a bent in the firing pin, and a mechanical connection is operative between the toggle mechanism and the sear to disengage the sear from the bent after the toggle mechanism is moved over centre.

The mechanical connection conveniently comprises a sear release pin slideable transversely in the firing pin so that one end of the pin can contact the sear and the other end of the pin can contact the toggle mechanism, the length of the pin being such that when the toggle mechanism moves over centre it pushes the pin against the sear to disengage the sear from the bent.

Advantageously, the firearm comprises a magazine from which a fresh round of ammunition can be supplied to the breech on removal of the case of a spent round.

The magazine can be a rotary magazine comprising a magazine body defining around part of its circumference an opening through which a round of ammunition can be inserted or withdrawn, and around a remaining part of its circumference defining a circumferential restraint through which a round cannot be inserted or withdrawn;

a carrier rotatable within the body about a carrier axis and having radially extending portions adjacent pairs of which define positive locations in which a round of ammunition can be accommodated on insertion through the opening, rounds being slideable longitudinally in said positive locations;

resilient carrier biasing means for urging the carrier to rotate in a particular bias direction;

a guide member moveable across the opening;

said guide member having a guide surface facing against the bias direction so that a round inserted through the opening is guided thereby into one of said positive locations and simultaneously rotates the carrier against its bias;

said guide member having a round-retaining surface facing towards the bias direction which can co-operate with one of the positive locations to positively retain the first-inserted round against circumferential and radial movement; and restraining means for holding the guide member in a position such that the guide surface faces the opening whenever the carrier occupies a position corresponding to one in which the magazine contains less rounds of ammunition than its maximum capacity, the guide member being moveable against the bias direction during movement of the carrier corresponding to insertion of the final round so that the first-inserted round may then pass through the position occupied at other times by the guide means.

Alternatively the magazine can be of a form in which one or more rimmed rounds of ammunition may be stacked each in contact with an adjacent round the firearm comprising resilient magazine bias means;

a breech opening through which a round of ammunition may be inserted into the magazine, the breech opening defining transverse guide means through which a round can be inserted in a direction transversely of the barrel axis against the action of the magazine bias means, and restraining means which are effective on subsequent forward movement of the inserted round to restrain the round in the breech against the action of the magazine bias means;

a catch which can assume a locking position in which it prevents return of a round forwardly located in the breech to a position in which it can re-enter the transverse guide means;

further guide means by which a round in the breech can be guided in a direction transversely of the barrel axis and rearwardly into the magazine against the magazine bias means on insertion of a further round into the breech;

the catch being effective to keep separate the rims of one round and a subsequently inserted round during the insertion of the subsequently inserted round, whereby the subsequently inserted round when engaged in the breech has its rim in front of the rim of the said one round.

Figure 2:
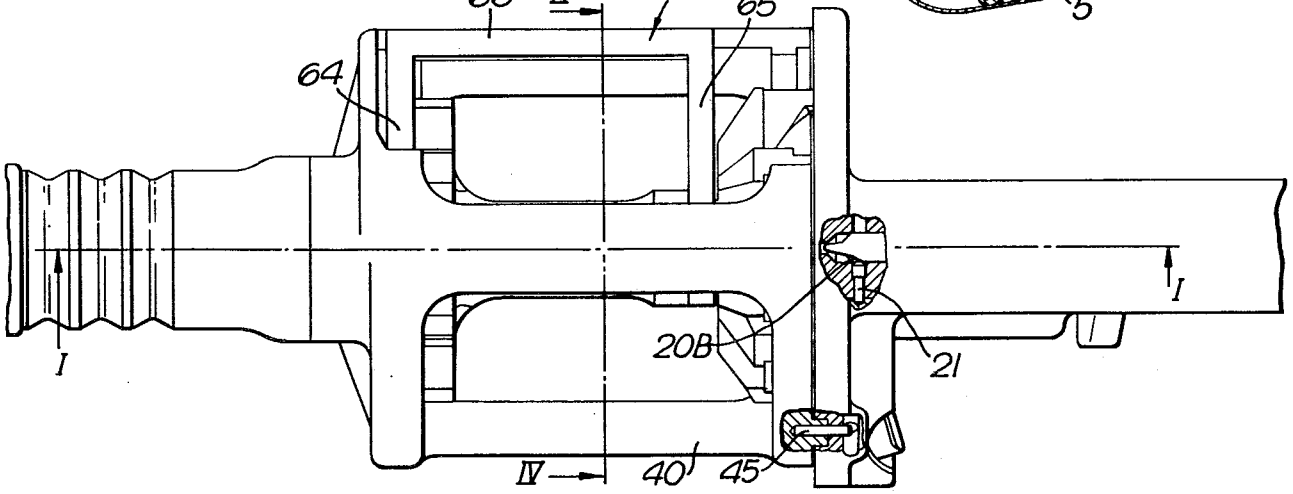
Figure 1A:
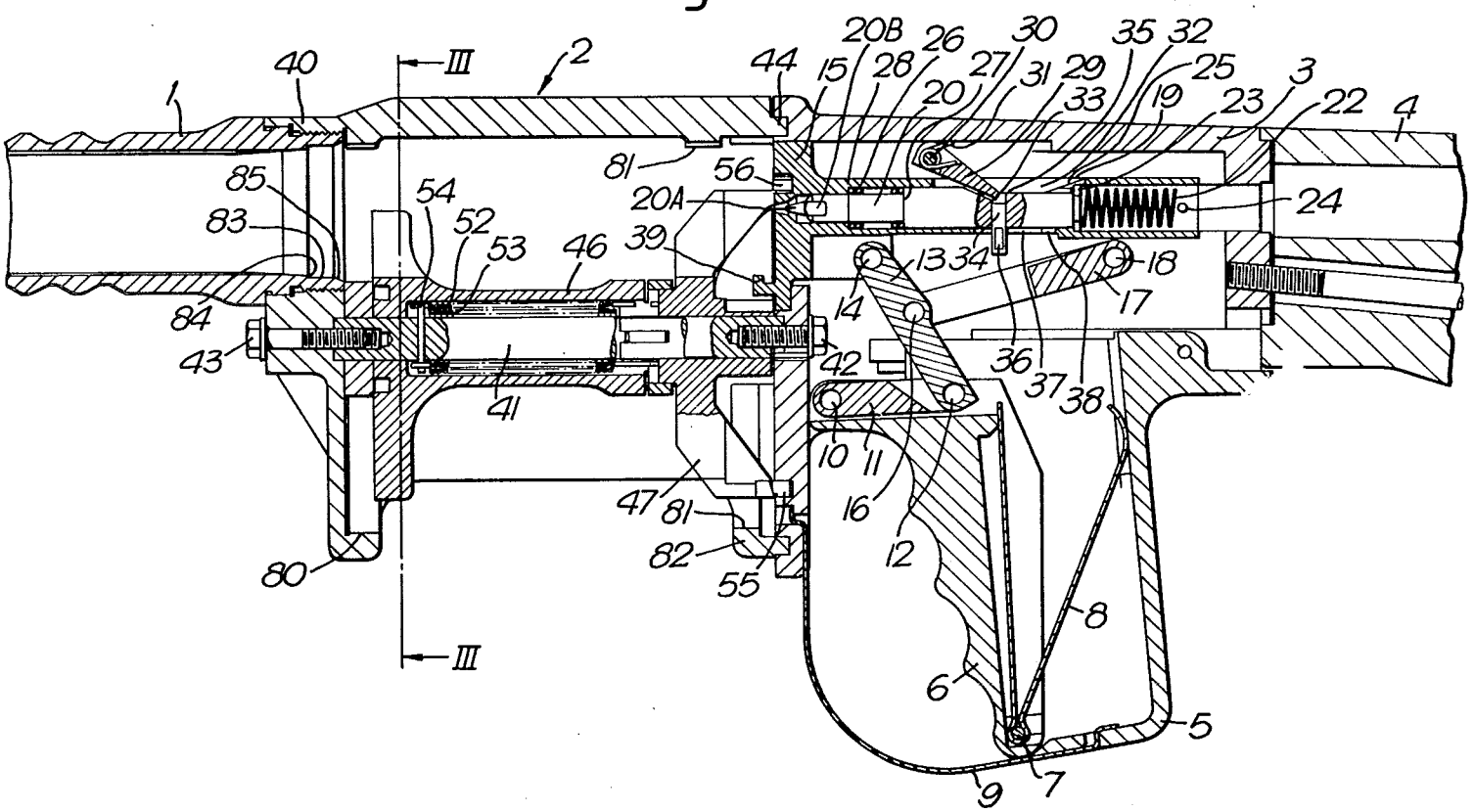
Figure 3:
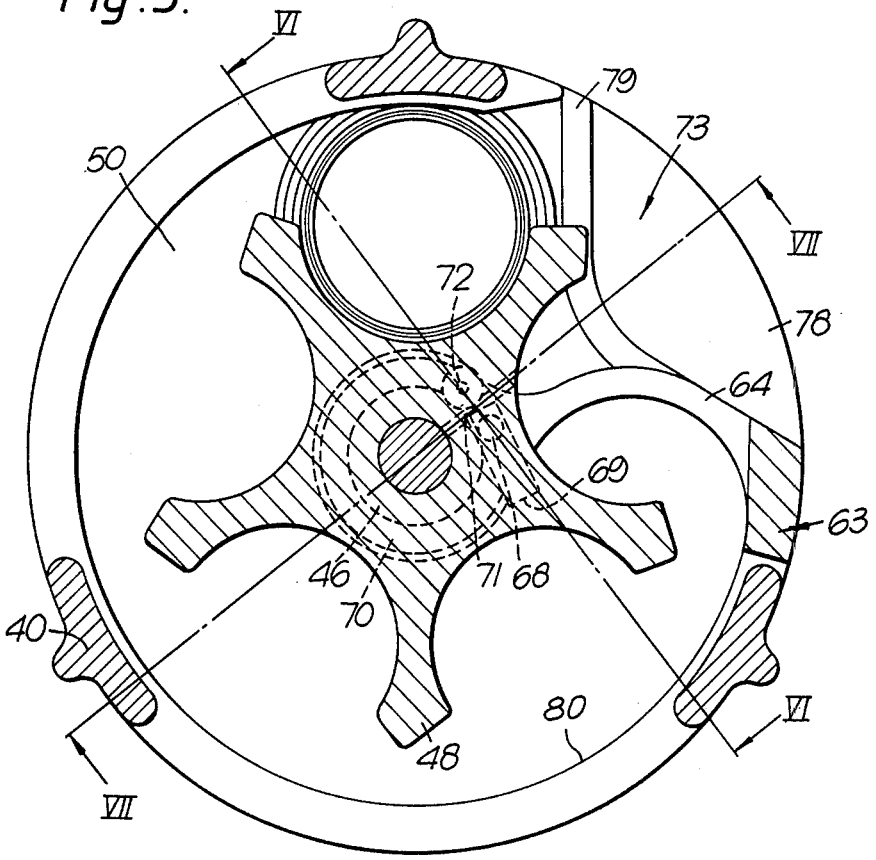
Figure 6:
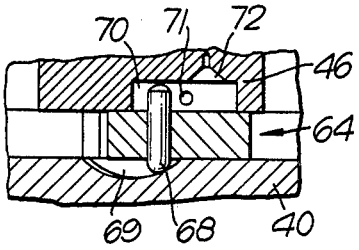
Figure 7:
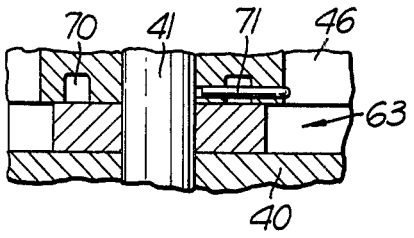
Figure 4:
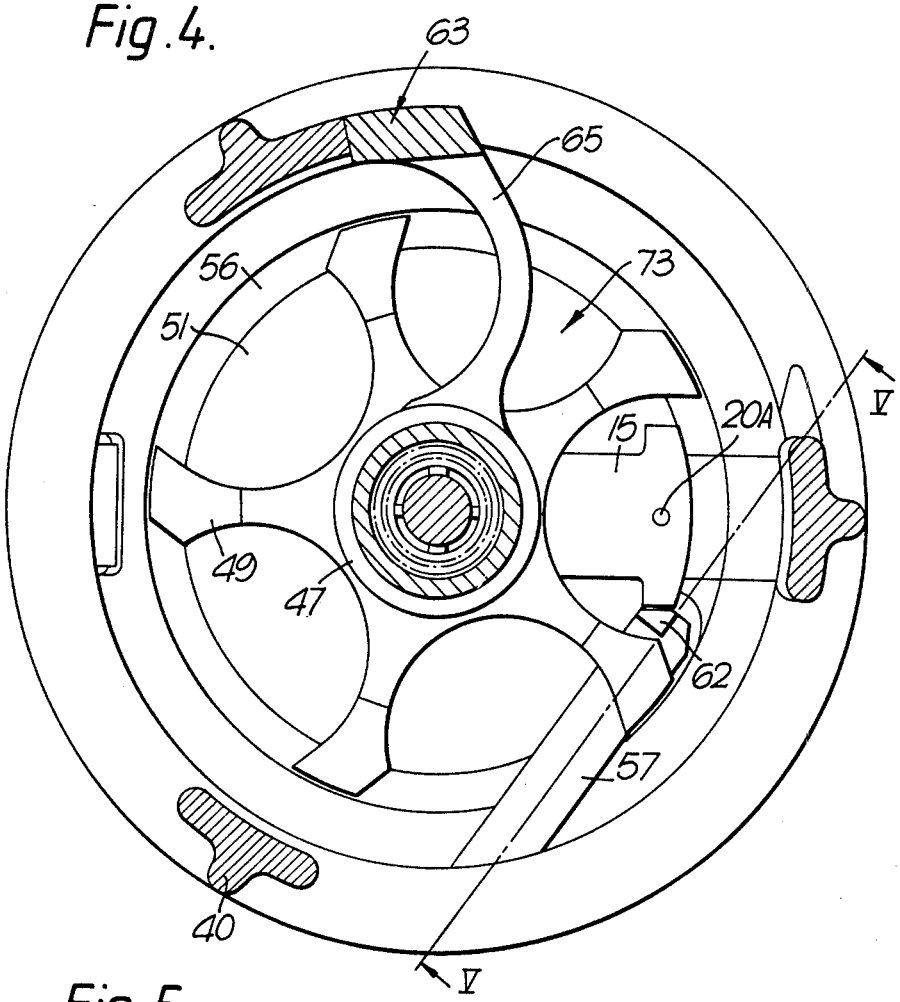
Figure 5:
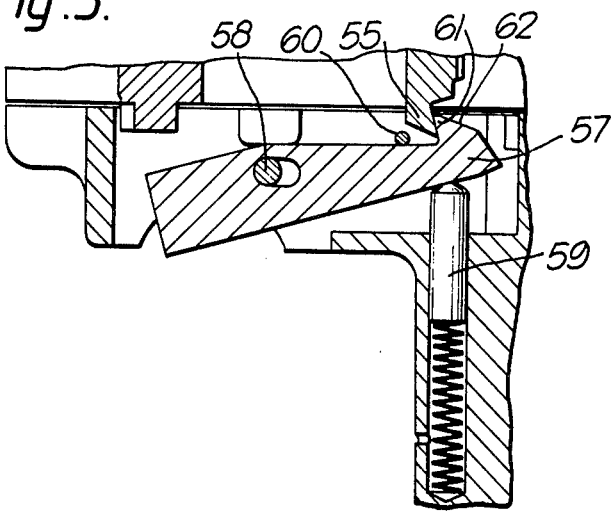
Figure 9:
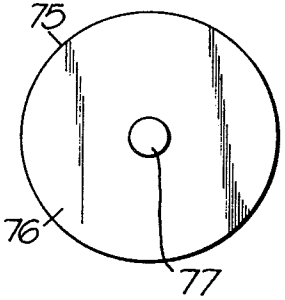
Figure 8:
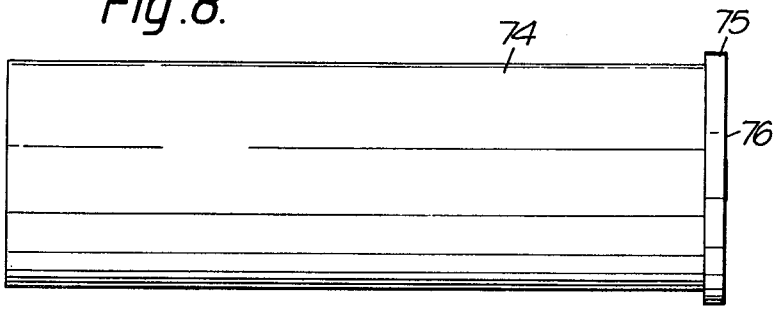
Figure 10:
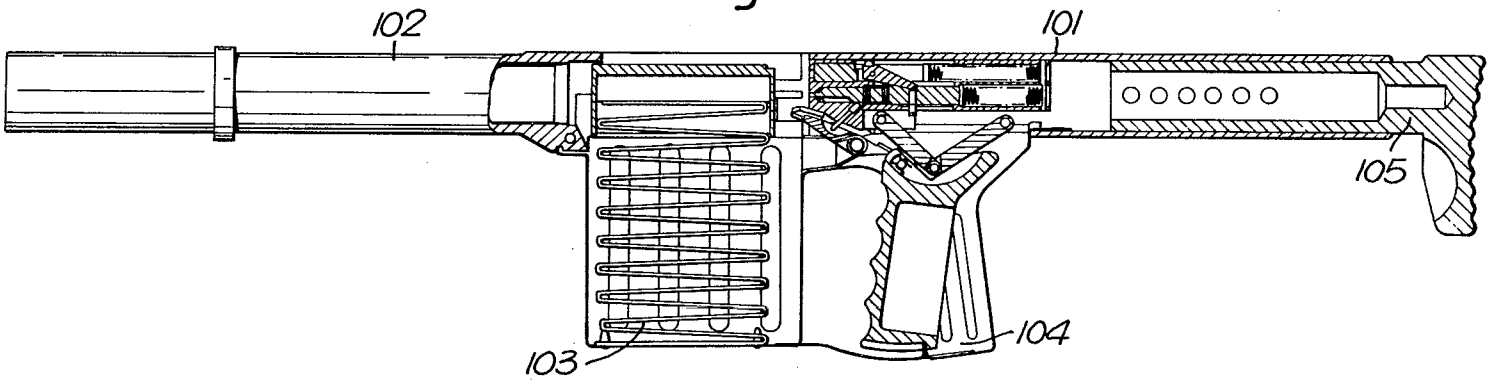
Figure 10A:
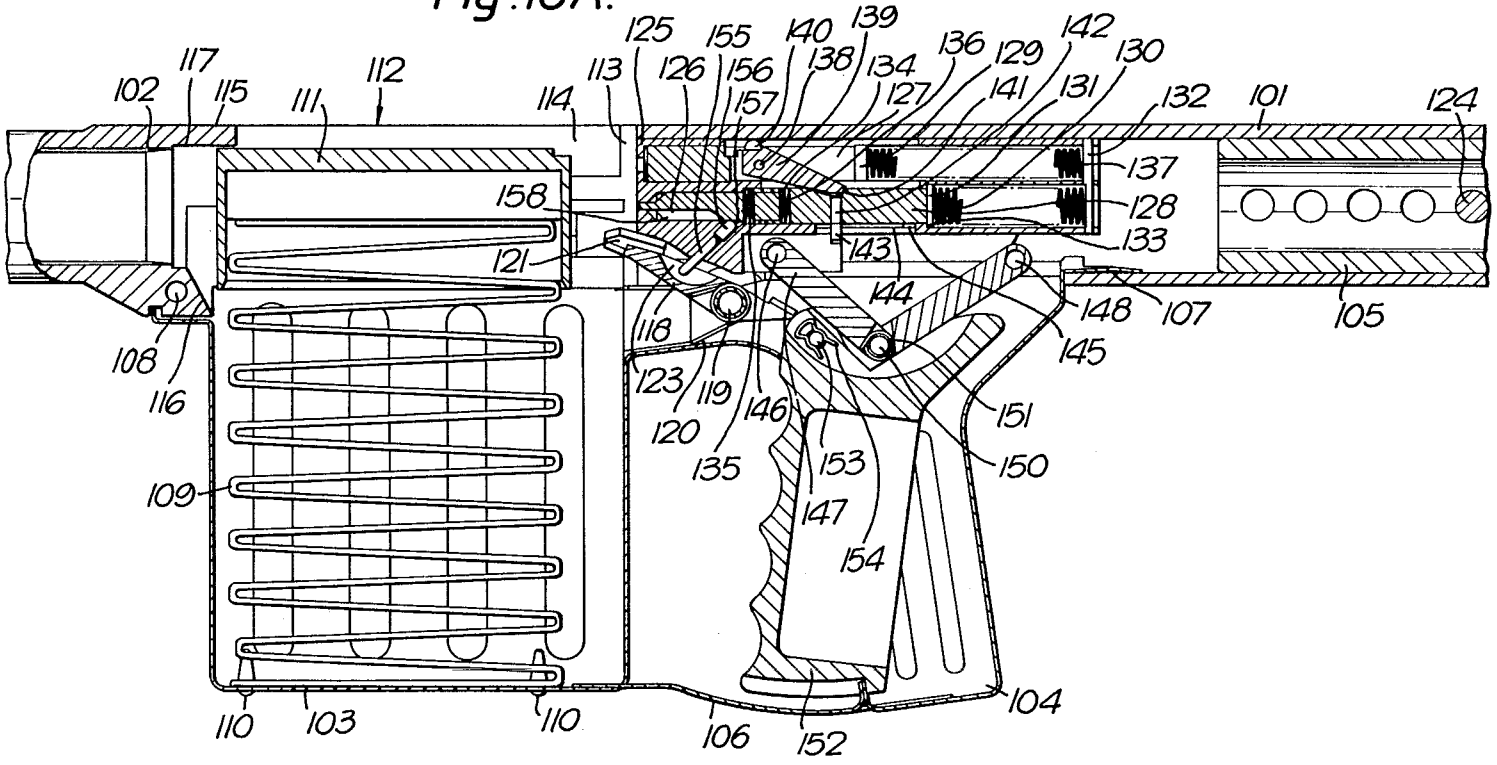
Figure 11:
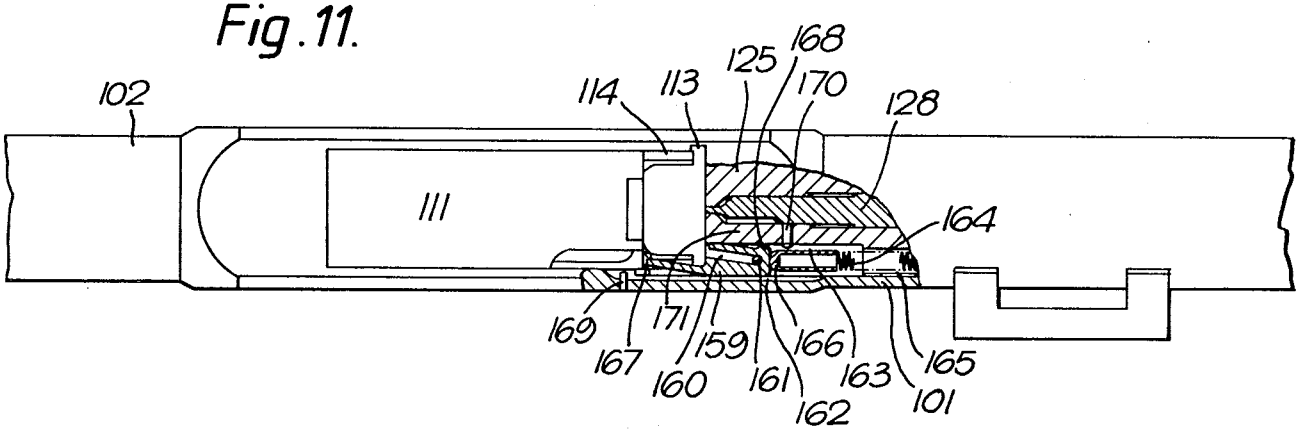
Figure 12:
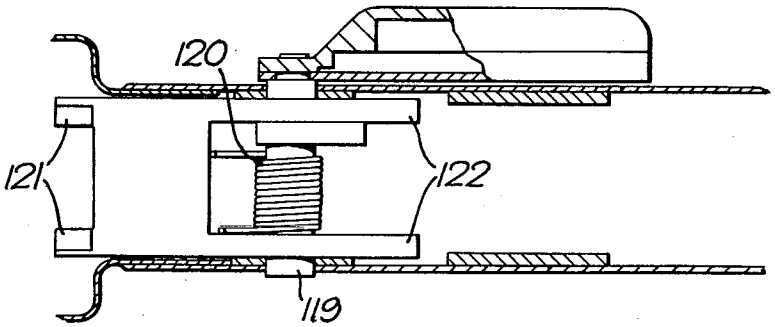

The invention will now be described by way of example only with reference to the accompanying drawings, of which FIG. 1 is a side elevational view on the line I—I of FIG. 2 of a first embodiment of firearm in accordance with the invention, FIG. 1A shows a part of FIG. 1 to an enlarged scale FIG. 2 is a plan view, part in section of part of the firearm shown in FIG. 1, FIG. 3 is a sectional end elevation on the line III—III of FIG. 1A, FIG. 4 is a sectional end elevation on the line IV—IV of FIG. 2, FIG. 5 is a sectional part view on the line V—V of FIG. 4, FIG. 6 is a sectional part view on the line VI—VI of FIG. 3, FIG. 7 is a sectional part view on the line VII—VII of FIG. 3, FIG. 8 is a side elevational view of a round of ammunition suitable for use in the firearm of FIGS. 1 to 7, FIG. 9 is an end elevational view of the round of ammunition shown in FIG. 8, FIG. 10 is a sectional elevational view of a second embodiment of firearm in accordance with the invention, also intended to use rounds of ammunition of the type shown in FIGS. 8 and 9, FIG. 10A shows a part of FIG. 10 to an enlarged scale, FIG. 11 is a plan view, part in section, of part of the firearm of FIG. 10, and FIG. 12 is a sectional view from below of a loading catch forming part of the firearm of FIG. 10.

As shown in FIGS. 1 to 7, a self-loading firearm comprises a barrel 1, a rotating magazine assembly 2, a firearm body 3 housing a breech block and firing mechanism, a butt assembly 4 and a pistol grip 5. A trigger 6 is pivoted at 7 in the base of the pistol grip 5, and is biased to rotate anticlockwise about the pivot 7 by means of a double leaf spring 8 stressed against the rear of the pistol grip 5. A trigger guard 9 protects the trigger against accidental operation.

Pivoted at 10 to the forward upper portion of the trigger is a link member 11, which extends generally rearwardly from its pivot point 10. Pivotally fixed at a pivot point 12 to the rear end of the link member 11 is a rearward extension of a first toggle bar 13. Toggle bar 13 is pivotally connected at its forward end by pivot 14 to a breech block 15 slideable longitudinally in the body 3. Pivotally connected by a pivot 16 to an intermediate point on the first toggle bar 13 is a second toggle bar 17 which extends rearwardly from the pivot 16, and is itself pivoted by a pivot 18 to the body 3.

Slideable longitudinally within a channel 19 in the breech block 15 is a firing pin 20 having a hardened forward tip portion 20A, and a side cheek 20B which can bear on a pin 21 held captive in a transverse bore in the body 3. (FIG. 2)

A strong helical compression spring 22 provided with a thrust cap 23 is located rearwardly of the firing pin 20 in the bore 19 between a retaining pin 24 and a shoulder 25 of the bore 19. A relatively weak helical return compression spring 26 is also located in the bore 19 between a forward-facing shoulder 27 on the firing pin 20 and a shoulder 28 of the bore 19.

A sear 29 pivoted to the body 3 by pivot 30 is urged to turn clockwise (as viewed in FIG. 1) about the pivot 30 by a spring 31, towards engagement with the firing pin 20. The tip of the sear 29 can engage, through a longitudinal slot 32 in the breech block 15 with a bent 33 on the firing pin 20, to restrain the firing pin from forward movement. A sear control pin 34 of generally cylindrical form can slide in a transverse bore 35 in the firing pin 20. The pin 34 has a flat 36 formed on its lower portion, but not extending to its lower end. The width of the pin 34 at the section of the flat 36 is such as to permit that section of the pin to slide along a longitudinal slot 37 in the breech block 15 which is of a width less than the full diameter of the pin 34. The length of the flat 36 in the direction of the pin axis is such as to permit a limited sliding transverse movement along the bore 35, but escape of the pin 34 is prevented by abutment of its full diameter portions against the edges of the slot 37. During assembly, the pin enters the slot 37 through a keyhole 38 in the breech block 19, but during normal operation of the firearm the relative movement of the firing pin 20 and the breech block 19 is limited so that the pin 34 does not become aligned with the keyhole 38.

The magazine assembly 2 comprises a magazine body 40 and a spindle 41. The spindle is secured to the firearm body 3 by means of a screw 42, and the magazine body 40 is secured to the spindle by means of a screw 43. A spigot 44 on the body 40 locates within a corresponding socket on the body 3 and correct alignment is ensured by an alignment pin 45 (FIG. 2) secured to the body 40 and fitting closely within a corresponding alignment recess in the body 3. Mounted for rotation on the spindle 41 is a star wheel assembly comprising a forward star wheel 46 and a rearward star wheel 47 locked to rotate together by means of dogs. The star wheels 46, 47 are of mutually similar transverse cross-section as best seen in FIGS. 3 and 4, each comprising respectively five evenly spaced radially-extending arms 48, 49 shaped to define a slightly less than semi-circular recess 50, 51 between each adjacent pairs of arms, the recesses of the two star wheels being axially aligned with one another. The star wheel assembly 46, 47 is urged to rotate in a clockwise direction as viewed in FIG. 3, by means of a pair of helical torsion spring 52, 53 mounted around the spindle 41. At their forward end, the springs 52, 53 have tails which bear against a cross-pin 54 to restrain rotation around the spindle. At their rearward ends, the springs 52, 53 have tails which engage in corresponding holes in the forward face of the star wheel portion 47. Thus when the star wheel assembly 46, 47 is turned anticlockwise (as viewed in FIG. 3), a torsional restoring force is provided by springs 52, 53. A certain degree of torsion is imparted to the springs 52, 53 during assembly so that they bias the star wheel assembly to turn clockwise as viewed in FIG. 3.

Each arm of the star wheel 47 is provided with a rearwardly projecting tail 55 which runs freely, as the star wheel rotates, in an annular recess 56 in the adjacent end face of the body 3. As seen in FIG. 5, a catch 57 having a slotted pivotal mounting 58 in the body 3 is urged forwardly by the action of a spring loaded plunger 59, the forward movement of the catch being limited by a stop pin 60. The catch 57 has a hooked portion 61 adapted, when in its forward position, to engage and restrain an adjacent tail 55. The catch 57 also has a cam face 62 engageable by the outer end of the pin 21.

A loading arm 63 is provided comprising a pair of curved arms 64, 65 freely pivoted respectively on the spindle 41 just ahead of the star wheel 46, and on a boss formed on the forward portion of the star wheel 47. The arms 64, 65 are linked rigidly together by a longitudinally extending guide bar 66.

Referring particularly to FIGS. 3, 6 and 7, a floating pin 68 received in a longitudinal bore in the forward curved arm 64, where it is held captive between the front face of the star wheel 46 and the rearward face on the body 40. As shown, the forward end of the pin 68 is received in a curved depression 69 in the forward face of the body 40, and the rearward end of the pin 68 is received in an annular grove 70 in the forward face of the star wheel 46. A cross pin 71 fixed by adhesive in a radial bore in the star wheel 46 extends across the groove 70 and acts as a stop to prevent the star wheel assembly 46, 47 making substantially more than a single revolution relative to the loading arm 63.

The pin 68 is of a greater length than the depth of the groove 70 plus the thickness of the forward curved arm 64, so that normally the pin 68 projects into the depression 69 so that the loading arm 63 is locked stationary with the body 40, while the star wheel assembly can rotate relative thereto, the groove 70 providing clearance for the pin 68.

A conical depression 72 is provided in the base of the groove 70, adjacent the cross pin 71. When the star wheel assembly 46, 47 has completed almost a full revolution relative to the body 40 from the position illustrated, the end of the pin 68 within the groove 70 can enter the depression 72, which is of sufficient depth to enable the other end of the pin 68 to clear the depression 69. The loading arm 63 can then move relative to the body 40 between limits set by an opening 73 for the insertion of rounds of ammunition therein; the disengagement of the pin being facilitated by the curved shape of the depression 69. During this movement the star wheel 46 and the loading arm 63 are locked together by the pin 68.

The round of ammunition for which the firearm is designed is shown in FIGS. 8 and 9. It comprises a cylindrical case 74 which contains a projectile (not shown) such as for example a so-called rubber bullet. The round is also provided with a projecting rim 75 at its rearward end, and in the rearward face 76 there is provided a percussion cap 77 by which the rounds may be fired. The case is designed so as to be substantially self-supporting, ie insertion into a supporting chamber to prevent rupture of the case when the round is fired is unnecessary.

Rounds may be inserted into the magazine through the opening 73. Entry of a fresh round is facilitated by a recessed portion 78 on the forward face of the magazine body 40, bounded by a chamfered portion 79. After insertion through the opening, a round is located in a corresponding pair of recesses 50, 51 which provide a positive location therefor in the star wheels 46, 47. As the star wheel assembly is rotated, the forward end of the casing 74 is restrained from radially outward movement by a part-circular rim 80 which extends around the whole of the forward face of the body 40 with the exception of the region of the opening 73 (see FIG. 3). At the rear end, the casing is restrained from radially outward movement by an arcuate rim 81. The casing is restrained from axial movement around the whole circumference of the body except the region of the opening 73 and the breech region, by a radially inwardly directed lip 82 behind which the rim 75 locates. In the region of the breech, the round is restrained axially by a lip 39 on the breech block 15. The concave surfaces of the curved arms 64, 65 of the loading arm 63 are approximately semi-circular for a reason explained hereinafter, the radius being approximately equal to that of the casing 74.

The barrel 1 is provided at its breech end with a very short chamber in the form of a socket portion 83 in which the forward end of a round can be received. The socket portion 83 has a shoulder 84 which the round cannot pass, and entry to the chamber is facilitated by a short chamfered section 85.

In use of the firearm, any number of rounds up to five may be placed in the magazine by successive insertion through the opening 73. As the first round is inserted, its entry is facilitated by the recess 78 and chamfered portion 79. The loading arm 63 is locked by the pin 68 in the position illustrated. The loading arm hence cannot pivot to a position where it hinders entry of the round. As the round is pressed inwardly into position the arms 64, 65 guide the round so that it moves also in an anticlockwise direction (as viewed in FIG. 3), towards alignment with the barrel, ie towards the breech position. The casing 74 of the round thus bears on the arms 48, 49 of the star wheels 46, 47 to move the star wheels anticlockwise (as viewed in FIG. 3), against the torsional bias of the springs 53, 54 until the round is fully received in a corresponding pair of recesses 50, 51. As the round reaches the position where it is aligned with the barrel 1 the hook 61 of the catch 57, under the action of the spring-loaded plunger 59, snaps into place behind the tail 55 of an arm 49. The star wheel assembly is hence held in this position against the bias of the springs 53, 54 by a ratchet action of the catch 57, with the round in the breech aligned with the barrel.

A second, third and fourth round may be inserted in exactly the manner described above. As the rounds move around the magazine they are restrained inwardly in the recesses 50, 51 of the star wheels 46, 47 and outwardly by rims 80, 81 whilst longitudinal movement of the rounds is restrained by lips 39 and 82 engaging rims 75.

However, when it is desired to insert a fifth round, the loading arm obstructs the path of the first round. This difficulty is overcome as follows. As the fifth round is inserted, the star wheel 46 moves to the position in which the recess 72 comes into alignment with the pin 68. As the first round pushes against the loading arm, the pin 68 is urged by the camming action of the curved surface of the depression 69 to move into recess 72, so that the loading arm becomes simultaneously unlocked from the magazine body 40, and locked instead with the star wheel 46. Hence as the action of inserting the fifth round continues, the first round moves round into the opening 73. However, the first round is prevented from escaping through the opening 73 by the loading arm 63 locked to the star wheel 46 so that the semi-circular recesses 50, 51 together with those of the arms 64, 65, enclose the round over about three-quarters of its circumference.

When the trigger 6 is pulled with the magazine 2 loaded, the action is as follows. The link member 11 is moved rearwards and is hence forced to pivot anticlockwise (as viewed in FIG. 1). The pivot 12 is thus forced to move upwards, so that the toggle mechanism comprising the first toggle bar 13 and the second toggle bar 17 begins to straighten. The breech block 15 is hence moved forward by virtue of the pivotal connection 14, carrying with it a round positively engaged behind the lip 39. As the breech block moves forward, the round slides longitudinally through its recesses 50, 51 to located in the socket 83 in the barrel 1.

As the breech block moves forward, the firing pin 20 is held on the sear 29, so that the spring 22 becomes compressed between the firing pin 20 and the retaining pin 24. When the toggle mechanism 13, 17 reaches its fully straighened position, the round is fully engaged in the socket 83 and the breech block is safely locked against rearward movement. A small further trigger movement brings the toggle mechanism to a position where it is locked slightly over-centre with the upper surface of the second toggle bar 17 bearing on the pin 34 and pushing it upwards to disengage the sear 29 from the firing pin 20. The firing pin then shoots forward under the action of the spring 22, until it reaches the position shown in FIG. 1, where the thrust cap 23 bears on the shoulder 25. Thereafter the firing pin continues forward at high speed, under its own inertia, so that its hardened tip 20A strikes the percussion cap 77 to fire the round. It will be noted that the casing of the round is almost totally unsupported at the time of firing.

As the firing pin moves forward, it compresses the return spring 26 between the shoulders 27 and 28. As the firing pin approaches the firing position, the cheek 20B contacts the pin 21 and forces it outwards by a camming action on to the side surface of the firing pin 20. The outer end of the pin 21 now projects in front of the cam face 62, but only if the firing pin has shot fully forward to fire the round.

As the trigger 6 is released, it returns under the action of the leaf spring 8, the toggle mechanism 13, 17 is pulled down by the return of the link 11, and the breech block 15 is hence drawn back towards its original position, taking with it the firing pin 20, and the spent case of the fired round which is held by the lip 39.

During this return movement the firing pin remains in a forward position relative to the breech block (although retracted clear of the front face of the breech block by the spring 26). The pin 21 is thus held outwardly during the return movement by contact with the flank of the firing pin. As the breech block moves back, the pin 21 bears on the face 62 of the catch 57, to pull the catch backwards and disengage the hooked portion 61 from the adjacent tail 55. The star wheel assembly 46, 47 is thus freed from the catch 57 which now moves downwardly in its slotted pivot to clear the pin 21 and snap into position ready to catch the next succeeding tail 55. The star wheel assembly 46, 47 is restrained from rotation under the action of the springs 52, 53 until the spent case has cleared the socket 83 and the chamfered portion 85, and the breech block has cleared the star wheel 47. When this stage is reached, the star wheel assembly is freed to index forward under the action of the springs 52, 53 until the catch 57 engages the next succeeding tail 55. The spent case is thus automatically ejected through the opening 73, and the next round (if any) in the magazine is automatically indexed around into alignment with the breech block 15 and the socket 83 where it is ready to fire. It should be noted, however, that this sequence can occur only if the firing pin 20 has been released and moved forward to fire a round, thus countering the possibility of a live round being accidentally ejected.

When the breech is fully retracted the sear 29 moves under the bias of the sear spring 31 into engagement once more with the bent 33 on the firing pin.

As long as the magazine contains another round, the sequence can be repeated and all of the rounds in the magazine may thus be fired in rapid succession by repeated operation of the trigger.

If it is desired to remove rounds from the magazine without firing, this may be achieved by manually depressing the tail (visible in FIGS. 2 and 5) of the catch 57, whereupon the star wheels 46, 47 are released and the rounds are ejected automatically in sequence in similar manner to the ejection of rounds when spent. Further rotation of the star wheel assembly could release all torsional pre-stress in the springs 52, 53 and so detract from subsequent proper functioning of the magazine feed. This is prevented by the pin 68 coming against the cross pin 71 just after the last round is ejected.

The embodiment of the invention shown in FIGS. 10 to 12, comprises a body 101 integral with a barrel 102, a magazine casing 103, a piston grip 104 and an adjustable butt 105. The magazine casing 103 and piston grip 104 are formed integrally as a steel pressing, and a trigger guard 106 is welded thereto. This assembly is attached under an opening in the body 101 by a tail 107 on the pistol grip and a transverse pin 108 passing through a forward projection (not shown) on the magazine casing.

The magazine casing 103 houses a wire spring 109 positioned in the base of the casing by riveted pins 110. Carried on the top of the spring 109 is a magazine platform 111 having an upper surface of semicylindrical general form. The platform 111 is hollow and can accommodate the compressed spring 109 when fully depressed into the casing 103.

An opening 112 is provided in the upper surface of the body 101 above the magazine casing, through which rounds of the type shown in FIGS. 8 and 9 may be inserted. A groove 113 is provided in each side wall of the opening to accommodate the rim 75, the adjacent wall portions near the upper edge of the opening 112 constituting cheeks 114 between which the cylindrical casing 74 of a round may pass, but the rim portion 75 may not. Below the cheeks 114, the opening widens to permit entry of a rim 75. At the forward end of the opening 112, the rearward end of the barrel 102 has an upper overhanging portion 115 beneath which the forward end of a round may be held, and a lower chamfered portion 116 which can guide a round downwards and rearwards into the magazine casing 103. The rearward end of the barrel also has a socket 117 constituting a short chamber into which the forward end of the casing 74 may be engaged prior to firing.

A loading catch 118 is pivoted at 119 in the steel pressing 103, 104 and is biased clockwise (as viewed in FIG. 10) by a spring 120. The loading catch 118 has a pair of limbs 121 which extend forwards into the opening 112, a pair of limbs 122 which extend rearwardly, and is provided with an arcuate depression 123 in its upper surface.

The rear portion of the body 101 is of generally cylindrical form, and a cylindrical portion of the adjustable butt 105 is slideable longitudinally therein so that the butt length may readily be adjusted to suit the user. The adjustable butt may be locked in a desired position by insertion of the butt locking pin 124 through holes provided in the body 101 and the butt 105.

Slideable longitudinally in the body 101 in front of the butt 105 is a breech block 125 of generally cylindrical form. Slideable longitudinally within respective bores 126 and 127 in the breech block 125 are a firing pin 128 and a sear block 129. The firing pin can be biased forwardly relative to the breech block by a firing pin spring 130 having a thrust washer 131 at its forward end. The forward movement of the spring 130 is limited by the washer 131 coming into contact with a shoulder 133 in the bore 126. The spring 130 is held within the bore 126 at its rearward end by a cross pin 132 located at the rear end of the breech block. A relatively weak firing pin return spring 134 acts between a shoulder 135 and the bore 126 and a shoulder 136 on the firing pin 128, to urge the firing pin rearwards.

The sear block 129 is urged forward by a sear spring 137 whose rearward end also reacts against the cross pin 132. Pivoted on a transverse sear pivot 138 within a longitudinal slot in the sear block 129 is a sear 139. The sear has a bent on its upper edge which engages with a transverse pin 140 located in the body 101. The sear also has a nose which can engage with a bent 141 in the firing pin 128. A sear pin 142 is slideable vertically in a bore which passes through the firing pin beneath the sear bent. The sear pin 142 is of generally cylindrical form, but has a reduced diameter portion 143 which can slide longitudinally within a longitudinal slot 144 in the breech block 125. During assembly, the pin 142 can enter the slot 144 through a keyhole 145, but cannot escape therefrom during normal operation of the firearm. The pin can move vertically between limits determined by the length of the reduced diameter portion and the depth of the slot 144.

Pivoted to the breech block 125 at 146 is a first toggle bar 147. Pivoted to the body 101 at 148 is a second toggle bar 149. The first and second toggle bars are pivoted to each other at 150 to constitute a toggle mechanism, which is biased downwardly by a toggle spring 151.

A trigger 152 is pivoted at 153 to the pistol grip 104, the pivot being retained by spring clip 154. The upper surface of the trigger is formed in the shape of a V, and the lower surface of the second toggle bar bears on the rearward "arm" of the V.

A pin 155 has an enlarged head 156 by which it is held captive in a stepped bore 157 in the breech block 125, which bore 157 is angled forwardly and down from the bore 126 through to the exterior of the breech block. The pin 155 is prevented from escaping upwardly and rearwardly from the bore 157 by contact with the underside of the firing pin 128. When the firing pin is in a rearward position relative to the breech block 125, the head 156 thereof can retract into a cam slot 158 in the forward underside of the firing pin, so that the lower end of the pin 155 can retract into the breech block. As the firing pin nears its most forward position relative to the breech block, an arcuate portion of the cam slot 158 pushes the pin 155 downwards so that it projects from the breech block.

As shown in FIG. 11, a floating extractor 159 has an open slot 160 therein by which it is held by means of a transverse pin 161 fixed in the breech block 125. The extractor 159 can slide longitudinally relative to the breech block in a groove 162 in the body 101 and a groove 163 in the side of the breech block, and can also pivot on the pin 161 to an extent permitted by the space available between the grooves 162 and 163. The extractor is urged forwardly by an extractor spring 164 engaged in a recess 165 in the breech block and acting through a plunger 166. The plunger 166 bears on a flat rear face of the extractor, which is so angled that the forward end of the extractor is biased towards a position somewhat inwards from the groove 162. The extractor 159 has an inwardly-directed hook 167 at its forward end and a small inwardly-directed projection 168 at its rearward end. A short pin 169 fixed in the body 101 projects into the groove 162 to obstruct movement of the extractor forwards therein beyond the pin.

A pin 170 is slideable transversely in a bore in the breech block which opens into the bore 126 and the groove 163. When the firing pin occupies a forward position relative to the breech block, the inner end of the pin 170 bears on the flank of the firing pin, so that the outer end of the pin 170 is forced to project into the groove 163. When the firing pin occupies a rearward position relative to the breech block, a recess 171 in the flank of the firing pin comes opposite the pin 170 so that it can retract from the groove 163.

The firearm is loaded by inserting a rimmed round of the type shown in FIGS. 8 and 9 in through the aperture 112, with the rim passing down through the grooves 113 and the forward end of the round passing behind the overhanging portion 115. This action depresses the magazine platform 111 and compresses the spring 109, and also as the rim 75 bears on the limbs 121, the loading catch 118 is depressed about its pivot. As the rim clears the cheeks 114, the round is given a forward movement so that the rim passes below the cheeks, and the forward end of the round passes under the overhanging portion 115. This frees the limbs 121 from under the rim 75 so that the loading arm springs up behind the rear face 76 of the round to prevent the round being drawn back again. The round is thus held captive under the overhang 115 and the cheeks 114, in alignment with the barrel 102. The round may now be fired as described hereinafter, or alternatively a second round may be inserted in the same way as the first.

It will be observed that when a second round is inserted through the opening 112, its rim will occupy a position behind that of the first round. For reasons which will become more clearly apparent hereinafter, the feeding of rounds from the magazine back to the firing position in the breech will be obstructed if the rounds are stored in the magazine with the rim of a second-inserted round behind that of the first. Accordingly it is an important function of the loading catch 118 that it ensures that the first-inserted round enters the magazine with its rim behind that of the second.

This is achieved as follows. The second round is inserted on top of the first round with its rim in grooves 113. As the second round is pushed down the first round is guided downwards and rearwards by the chamber 116. At this point the rim of the second round depresses the loading catch 118 on to the rim of the first round, thus enabling the second round rim to pass over the rim of the first round when pushed forward engaging under the cheeks 114. As the second inserted round moves down and forward, the loading catch 118 snaps up behind it, locking the second round forward in the breech in the same way as the first. The first round now occupies a position in the magazine casing with the second round resting on top of it and holding it down against the spring 109, the rim of the second in front of that of the first.

The second round may now be fired as described hereinafter, or a third round may be inserted in the same way as the second. If a third round is inserted, the final position will be with the first and second rounds in the magazine, biased upwardly by the spring 109, and the third round resting on top of the second and holding it down. The third round will be in the breech, its forward end under the overhanging portion 115, its rim under the cheeks 114, and the arms 121 preventing its escape rearwards. The rim of the third round will be in front of the rim of the second round.

When the trigger 152 is pulled against the pistol grip 104, it pivots rearwardly about the pivot 153. The upper surface of the trigger bears against the second toggle bar 149, forcing it upwards and so straightening the toggle mechanism comprising the toggle bars 147, 149. As the toggle mechanism straightens, the breech block 125 is pushed forwards, but the firing pin 128 is restrained from forward movement by engagement with the sear 139. As the breech block moves forwards, the spring 130 is compressed between the pin 132 and the firing pin 128, and the spring 137 is compressed between the pin 132 and the sear block 129 held on the pin 140. If there is a round in position aligned with the barrel, forward movement of the breech block also pushes the round into positive engagement in the socket 117, the rim of the round sliding on the cheeks 114 against which it is held by the bias of the spring 109. As the round nears full engagement in the socket 117, the toggle bars 147, 149 reach the straight position and pass slightly over centre to lock the breech block 125 positively in a forward position. At the same time the upper surface of the first toggle bar 147 contacts the pin 142 and pushes it upwards to disengage the sear 139 from the bent 141 on the firing pin 128. The firing pin is thus freed to shoot forward at high speed under the action of the spring 130, and strike the percussion cap 77 of the round to fire it. It will be observed that in the position illustrated the spring 130 rests on the shoulder 133 (via the washer 131), but the tip of the firing pin remains within the breech block. The firing pin thus completes its forward movement under its own inertia, compressing the light restoring spring 134. The spring 134 then retracts the firing pin immediately after firing, so that its tip lies within the breech block clear of the percussion cap 77, where it cannot interfere with ejection of the spent case. When the trigger is released after firing, the toggle mechanism is pulled back from its over-centre position by the spring 151, and the breech block is retracted by the spring 137 compressed between the pin 132 and the sear block 127.

The extractor claw 159 is effective only whena round is present in the breech. At other times, the forward end of the extractor is angled inwardly under the bias action of the spring 164 on its rear face, so that it always clears the pin 169, and simply moves back and forth in unison with the breech block 125. When the extractor 159 is thus angled inwardly, the projection 168 can clear the pin 170 even when the pin 170 is fully extended by contact of its inner end with the flank of the firin pin 128.

When a round is introduced in front of the breech block 125, however, the rim 75 thereof contacts the extractor behind the hook 167 to push its forward end outwardly into the groove 162. In this orientation, the projection 168 cannot clear the pin 170 when fully extended by contact of its inner end with the flank of the firing pin, and forward movement of the extractor is limited by contact with the pin 169.

When the trigger is operated with a round in position in front of the breech block, the extractor 159 moves forward with the breech block 125 until the extractor contacts the pin 169. As the breech block moves forward further, the extractor is prevented from doing so, and the pin 161 slides along the slot 160 in the extractor, the rear end of the extractor bearing on the plunger 166 to compress the spring 164. At this stage of the firing sequence, the firing pin 128 is held to the body 101 by the sear 139, and hence it cannot move with the breech block. Thus as the pin 170 comes adjacent the projection 168 the pin 170 can retract into the recess 171 in the firing pin to clear the projection. When the firing pin is freed from the sear, the flank of the firing pin once again contacts the inner end of the pin 170 to hold it locked fully outwards, but now the pin 170 is in front of the projection 168. As the breech block and firing pin are retracted by the spring 137 on release of the trigger, the extractor is thus held to the breech block by the pin 170 engaging in front of the projection 168. Since the rim of the round is caught behind the hook 167, the spent case is withdrawn with the breech block until it clears the cheeks 114 and comes into line with the slots 113. The loading catch 118 is held down to permit this extraction to occur, as explained hereinafter. When the rim clears the cheeks 114 there is no influence restraining the spent case against the bias of the spring 109, and the spent case is thus ejected automatically through the opening 112. It will be appreciated that if the loading catch were not held down during this extraction sequence the upper and lower round are held in contact with one another by the spring 109. However, because it is held down the loading catch 118 itself in turn holds down the lower round so that the rim of the upper round can slide rearwardly and upwardly over the upper surfaces of arms 121, thus clearing the lower rim. The function of the loading catch is thus seen to be an exceedingly important one. In its absence, the spent case would be prevented by contact of its rim with the rim of the lower round, from retracting fully, and hence could not be ejected.

As soon as the spent case is ejected, the forward end of the extractor is free to move inwards under the influence of the spring 164 and the plunger 166 on its rear end. The resulting small rotation of the extractor is sufficient to enable the projection 168 to clear the pin 170 so that the extractor snaps back immediately (ie before the next round can rise into the breech to obstruct the forward movement of the extractor) to its forward position relative to the breech block, as shown in FIG. 11.

In order to permit extraction of the spent case, the loading catch 118 must be held down whilst the case is moved rearwards. This is achieved by the pin 155. When the breech block is moving forward to locate the round in the socket 117, the head 156 of the pin 155 can enter the cam slot 158 in the firing pin, so that the pin can retract when its outer end contacts the loading catch 118. As the breech block completes its forward movement the underside of the breech block contacts the arms 121 to depress the loading catch 118, but the pin 155 plays no part in this. However, when the firing pin is released from the sear 139, the pin head 156 is cammed outwardly by the rounded end of the cam slot 158, so that by the time the firing pin strikes the percussion cap 77, the pin 155 is held fully extended on the flank of the firing pin. In this position, with the breech block fully forward, the extended pin 155 contacts a flat upper forward surface of the catch 118 to hold the catch depressed so that the limbs 121 can pass under the rim 75 of the round being extracted and hold down the rim of the next succeeding live round. As the firing sequence is completed, the breech block and firing pin are withdrawn in unison, with the pin 155 hence still extended. This rearward movement first clears the breech block of contact with the loading catch 118, but the catch cannot rise again to the position shown in FIG. 10 until the breech block has withdrawn far enough for the pin 155 to enter the arcuate portion 123, by which time the spent case has passed rearwardly clear of the arms 121. It will be seen that the arrangement described has the great advantage of countering the possibility that a round which has not been fired will be accidentally ejected.

When the spent case is ejected, if there is no further round present in the magazine, the magazine platform rises under the influence of the spring 109 until restrained by contact with the overhanging portion 115. If, however, a further round is present it is urged upwardly by the spring 109. As it moves upwards, it is guided forwardly by curved under-surfaces of the limbs 121 of the loading catch 118, and at its forward end on the chamfered surface 116. The next round thus moves up in front of the loading catch 118 so that it is held captive by the cheeks 114 and the overhanging portion 115. A further firing sequence can then be initiated immediately by operation of the trigger, or alternatively the magazine can be re-filled by insertion of one or more rounds through the opening 112.

We claim:

1. A firearm having a body, a breech and an actuating mechanism, said firearm comprising:

a breech block slideable longitudinally relative to the body of the firearm and having a forward breech end for engaging and pushing forward a round of ammunition in the breech;

a firing pin slideable longitudinally relative to the body and to the breech block;

resilient means which can be stressed by forward movement of the breech block relative to the firing pin;

detent means engageable with the firing pin to prevent longitudinal movement of the firing pin relative to the body of the firearm; and a toggle mechanism comprising first and second toggle bars and forming at least a part of an operative linkage between a trigger and the breech block; the first toggle bar being pivotally connected at a first pivot point to the breech block, the second toggle bar being pivotally connected at a second pivot point to the body of the firearm, said first pivot point being forward of said second pivot point, and the first and second toggle bars being pivotally connected together at a third ivot point, the trigger being operatively linked with the toggle mechanism whereby initial operation of the trigger moves the third pivot point towards alignment with the first and second pivot points so that the breech block is moved forwards and the resilient means is stressed, and whereby further operation of the trigger moves the toggle mechanism over center to lock the breech block forward and releases the detent means, and wherein said detent means includes a sear engageable in a bent in the firing pin, and a mechanical connection operative between the toggle mechanism and the sear to disengage the sear from the bent after the toggle mechanism is moved over center, said mechanical connection including a sear release pin slideable transversely in the firing pin so that one end of the pin can contact the sear and the other end of the pin can contact the toggle mechanism, the length of the pin being such that when the toggle mechanism moves over center, it pushes the pin against the sear to disengage the sear from the bent.

2. A firearm according to claim 1 further comprising a magazine from which a fresh round of ammunition can be supplied to the breech on removal of the case of a spent round.

3. A firearm according to claim 2 wherein the magazine is a rotary magazine comprising a magazine body defining around part of its circumference an opening, through which a round of ammunition can be inserted or withdrawn, and around a remaining part of its circumference defining a circumferential restraint through which a round cannot be inserted or withdrawn;

a carrier rotatable within the body about a carries axis and having radially extending portions adjacent pairs of which define positive locations in which a round of ammunition can be accommodated on insertion through the opening, rounds being slideable longitudinally in said positive locations;

resilient carrier biasing means for urging the carrier to rotate in a particular bias direction; a guide member moveable across the opening;

said guide member having a guide surface facing against the bias direction so that a round inserted through the opening is guided thereby into one of said positive locations and simultaneously rotates the carrier against its bias;

said guide member having a round-retaining surface facing towards the bias direction which can cooperate with one of the positive locations to positively retain the first-inserted round against circumferential and radial movement; and restraining means for holding the guide member in a position such that the guide surface faces the opening whenever the carrier occupies a position corresponding to one in which the magazine contains less rounds of ammunition than its maximum capacity, the guide member being moveable against the bias direction during movement of the carrier corresponding to insertion of the final round so that the first-inserted round may then pass through the position occupied at other times by the guide means.

4. A firearm according to claim 2 wherein the magazine is of a form in which one or more rimmed rounds of ammunition may be stacked each in contact with an adjacent round the firearm comprising resilient magazine bias means;

a breech opening through which a round of ammunition may be inserted into the magazine, the breech opening defining transverse guide means through which a round can be inserted in a direction transversely of the barrel axis against the action of the magazine bias means, and restraining means, which are effective on subsequent forward movement of the inserted round to restrain the round in the breech against the action of the magazine bias means;

a catch which can assume a locking position in which it prevents return of a round forwardly located in the breech to a position in which it can re-enter the transverse guide means;

further guide means by which a round in the breech can be guided in a direction transversely of the barrel axis and rearwardly into the magazine against the magazine bias means on insertion of a further round into the breech;

the catch being effective to keep separate the rims of one round and a subsequently inserted round during the insertion of the subsequently inserted round, whereby the subsequently inserted round when engaged in the breech has its rim in front of the rim of the said one round.

5. A firearm according to claim 1, wherein the toggle mechanism moves the breech block longitudinally forward through a distance sufficient to ensure no more than a partial insertion of the round of ammunition into a locating socket, whereby the casing of the round is substantially unsupported at the time of firing.

* * * * *